US007789505B2

(12) United States Patent
Ageishi

(10) Patent No.: US 7,789,505 B2
(45) Date of Patent: Sep. 7, 2010

(54) ROLL FOR CHARGING BELT FOR INKJET RECORDING AND INKJET RECORDING APPARATUS

(75) Inventor: Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 954 days.

(21) Appl. No.: 11/589,458

(22) Filed: Oct. 30, 2006

(65) Prior Publication Data

US 2007/0268351 A1 Nov. 22, 2007

(30) Foreign Application Priority Data

May 18, 2006 (JP) ..... 2006-139016

(51) Int. Cl.
*B41J 29/38* (2006.01)
*B41J 2/01* (2006.01)

(52) U.S. Cl. ..... 347/104; 347/16

(58) Field of Classification Search ..... 347/104; 399/50, 168, 174, 176
See application file for complete search history.

(56) References Cited

U.S. PATENT DOCUMENTS 6,400,919 B1 * 6/2002 Inoue et al. ..... 399/176
6,440,347 B1 * 8/2002 Izawa et al. ..... 264/262
2002/0126193 A1 * 9/2002 Maki et al. ..... 347/104
2003/0118372 A1 6/2003 Kitano et al.
2003/0194625 A1 * 10/2003 Tanaka et al. ..... 430/58.8
2004/0161262 A1 * 8/2004 Uyama et al. ..... 399/149

FOREIGN PATENT DOCUMENTS

| | | |
|---|---|---|
| JP | 10-254215 | 9/1998 |
| JP | 2000-122376 | 4/2000 |
| JP | 2002-318495 | 10/2002 |
| JP | 2003-103857 | 4/2003 |
| JP | 2003-140443 | 5/2003 |
| JP | 2004-099280 | 4/2004 |
| JP | 2005-242260 | 9/2005 |
| JP | 2006-091185 | 4/2006 |

* cited by examiner

*Primary Examiner*—Matthew Luu
*Assistant Examiner*—Kendrick X Liu
(74) *Attorney, Agent, or Firm*—Fildes & Outland, P.C.

(57) ABSTRACT

The present invention provides a roll for charging a belt for inkjet recording, in which the roll has a surface layer including a fluororesin and having a nip resistance of $10^4$ to $10^8$ Ω at 23° C. and 55% RH formed on a roll having an underlayer formed on the outer peripheral surface of a metal core material, and an inkjet recording apparatus equipped with the roll for charging a belt for inkjet recording.

11 Claims, 4 Drawing Sheets

ROLL FOR CHARGING BELT FOR INKJET RECORDING AND INKJET RECORDING APPARATUS

BACKGROUND

1. Technical Field

The present invention relates to a roll for charging a belt for an inkjet recording apparatus and an inkjet recording apparatus, and especially relates to a roll for charging a belt, in which the roll performs charging of the belt and eliminating of the charge of the belt that transports a recording medium, and the inkjet recording apparatus.

2. Related Art

Conventionally, in an inkjet recording apparatus, images are formed on a recording medium by ejecting an ink liquid while the medium is scanned with an inkjet head moving in a main scanning direction, and after completing one scanning line, the medium is transported a predetermined increment in the sub-scanning direction, and the medium is scanned in the main scanning direction again.

In the transportation of the recording medium, because it is necessary to transport the medium a predetermined distance with high accuracy, the recording medium is transported while the medium is electrostatically attracted to the surface of a transporting belt by charging the transporting belt. When residual electric charges exist on the transporting belt, the desired amount of electric charge is not obtained so that a stable attraction force cannot be obtained.

In order to obtain a stable attraction force at the surface of the transporting belt, a method of a paper transporting apparatus equipped with a charge eliminating brush for eliminating charges on an electrostatic attraction belt has been known.

A method to perform charge elimination using a charge eliminating apparatus such as a corotron, a scorotron, a charge eliminating brush, and a charge eliminating roll in an apparatus such as an electrostatic recording apparatus is known.

However, in a paper transporting apparatus using a charge eliminating brush, the charge eliminating capability decreases at a part of transporting belt corresponding to the position where the brush bristles are deformed or have fallen out and the apparatus cannot perform stable charging property. Further, there is a concern that the bristles that have fallen out attach to other mechanisms in the paper transporting apparatus and cause adverse effects, and there is a problem that the reliability of the apparatus is lowered, for example, due to a concern of deteriorated charging property caused by bristles attached to a charger and a concern of deterioration in image quality caused by the bristles attached to the recording medium or the inkjet head.

In the method using the above-described charge eliminating apparatus such as a corotron and a scorotron, there is a problem that the apparatus is difficult to make small because of the additional requirement to have a mechanism to generate voltage and its required space, and also as a result, the cost of the apparatus as a whole increases. Further, the conventional corotron and scorotron are easily affected by the generation of ozone, surface hydrophilization, and discharging deterioration, and so such an apparatus is not preferable from the aspect of space taken up by the apparatus and cost.

On the other hand, in the conventional conductive roll using a direct current, although it is necessary to keep stability of the paper attraction properties by means of DC charging for maintaining an electric field retention when a belt is charged, electric characteristics are deteriorated because of contamination at the surface of the belt due to ink (or processing solution) mist and ink stain. Further, uneven charging due to change of shape and generation of recesses occurs easily.

In contrast, a conductive roll which enables charging of the transporting belt with high reliability with the aim of avoiding charge elimination has been provided. The conductive roll is simultaneously used for charging using both alternating current and direct current, and an electric resistance is controlled by a single layer conductive roll. However, the property of paper attraction of a paper such as a paper containing moisture varies easily with changes in the electric resistance due to environmental variations, and while the transportation and the charging of the belt are controlled, the residual charges on the belt vary with the location, size, and type of paper, and a stable attraction force cannot be obtained.

SUMMARY

According to an aspect of the invention, there is provided a roll for charging a belt for inkjet recording, wherein a surface layer, including a fluororesin and having a nip resistance of about $10^4$ to $10^8$ Ω at 23° C. and 55% RH, is formed on a roll having an underlayer formed at the outer peripheral surface of a metal core material.

DETAILED DESCRIPTION

Figure 1:
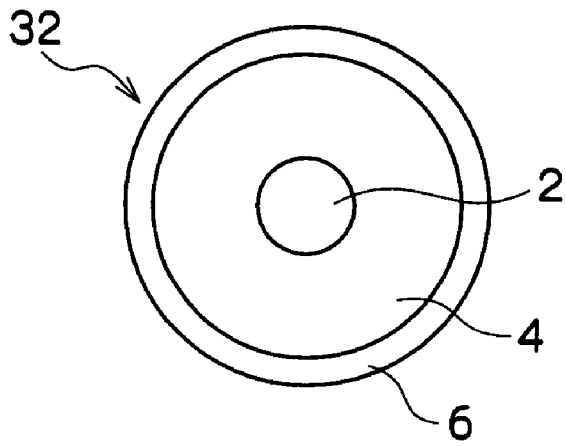
FIG. 1 is a schematic view showing a configuration of the roll for charging a belt for inkjet recording of the present invention.

The roll for charging a belt for inkjet recording in the present invention (hereinafter, referred to as "a charging roll of the present invention" in some cases) will be explained with reference to FIG. 1. As shown in FIG. 1, a charging roll 32 in the present invention wherein a surface layer 6, including a fluororesin and having a nip resistance of about $10^4$ to $10^8$ Ω at 23° C. and 55% RH, is formed on a roll having an underlayer 4 formed at the outer peripheral surface of a metal core material 2. The content of the fluororesin in the surface layer 6 is about 5% by mass or more, and preferably 50 to 80% by mass.

Because the charging roll 32 in the present invention has a two-layer structure of the underlayer 4 and the surface layer 6, it is effective as a functional layer of a surface protective layer having not only the function of adjusting the electric resistance of the roll, but it also functions to prevent dirt due to the adhesion of foreign matters on the surface of the belt, to suppress a decrease in electric resistance due to discharging products, to prevent dirt on a paper due to powder formed by abrasion, to suppress mechanical wear at the foamed body part, to prevent mechanical deformation, to suppress deformation at a nip portion, and the like.

Examples of the metal core material 2 used are not specifically limited and include stainless steel (SUS), copper, aluminum and the like.

The underlayer 4 may be any of a foamed layer having a dense skin layer on the surface or a non-foamed layer and is preferably a foamed layer for providing a uniform nip property. The underlayer 4 preferably comprises one kind of rubber such as an ethylene-propylene-diene copolymer (EPDM), silicone rubber, urethane rubber, acrylonitrile-butadiene rubber (NBR), epichlorohydrin rubber (ECO), and polyether-urethane (PU) rubber, or two or more kinds of rubber material components such as EPDM and silicone rubber, and especially EPDM, ECO, and a PU rubber are preferable. The volume resistivity of the underlayer 4 is generally $10^{14}$ Ωcm or more, and a conductive agent can be included in the underlayer 4 if necessary.

The thickness of the underlayer is preferably 1 to 30 mm and more preferably 2 to 6 mm. When the thickness is less than 1 mm, the metal core material tends to be deflected and is easily deformed, and there may be the case where it becomes difficult to keep a uniform nip; and when the thickness exceeds 30 mm, there may be the case where the amount of a belt nip increases, so that the change of the belt speed and running of paper, expansion and contraction in image quality and wrinkling of the paper may occur, resulting in paper jamming.

The surface layer 6 includes a fluororesin and has a nip resistance of about $10^4$ to $10^8$ Ω at 23° C. and 55% RH, preferably about $10^{4.5}$ to $10^7$ Ω, and more preferably about $10^{4.5}$ to $10^6$ Ω. When the nip resistance of the surface layer 6 is less than $10^4$ Ω, an excessive current flows during paper feed and a failure to attract the paper due to belt leakage occurs easily; and when it exceeds $10^8$ Ω, an amount of belt charge becomes large. The nip resistance is a value obtained by measuring an electric resistance when a load of 1 kg is applied and a voltage of 100V (charged for 10 seconds) is applied using a cylindrical electrode HR probe in HIGHRESTER IP manufactured by Mitsubishi Petrochemical Co. Ltd., and the nip resistance of the surface layer 6 is measured at the nip before a metal (SUS or aluminum pipe) having the same diameter is covered with a tube, and the nip resistance of the underlayer described later is measured under a condition of an applied load of 500 g (each end) and an applied voltage of 100V before the tube covering, in a similar manner.

In light of realizing a more stable charging behavior on the belt, the nip resistance of the surface layer 6 at 10° C. and 10% RH is preferably lower than the nip resistance of the underlayer (rubber underlayer) 4 at 10° C. and 10% RH, and the nip resistance of the surface layer 6 at 28° C. and 85% RH is preferably higher than the nip resistance of the underlayer 4 at 28° C. and 85% RH. Under the condition at 10° C. and 10% RH, the apparent nip resistance can be made small such that an increase in substrate resistance is suppressed so that the resistance of the surface layer is lower than the resistance of underlayer 4, and current at the nip portion allows to flow to the whole surface through the surface layer. On the other hand, under the condition at 28° C. and 85% RH, the drop in the substrate resistance due to decrease in the hygroscopicity and rubber elasticity can be suppressed by making the resistance of the surface layer 6 higher than the resistance of the underlayer 4, so that a more stable resistor body can be obtained.

Further, the coefficient of static friction of the surface layer 6 is preferably about 0.3 or less and the thickness is preferably about 30 to 500 μm. The above-described coefficient of static friction is more preferably about 0.25 or less and further preferably about 0.2 or less. When the above-described coefficient of static friction exceeds 0.3, acceleration of wearing out of the belt surface, slipping properties, and change in the speed may occur, a stable paper orientation cannot be easily achieved, resulting in an increase in the adhesion properties of foreign matters, and decrease in cleaning properties such as a blade, or the like. The thickness is 30 to 500 μm and further preferably 50 to 200 μm. When the thickness is 30 μm or less, occurrence of unevenness attributed to an influence of a polished pattern and foam pattern of the underlayer 4, generation of wrinkles, recesses, and the like attributed to deformation, and reduction in the adhesion properties of the substrate attributed to reduction in contraction rate may occur. When the thickness exceeds 500 μm, the surface layer is not likely subject to the influence of the underlayer 4, changes in belt-paper speed due to a nonuniform nip of the roll with a belt, scratches and wearing out on the surface, or the like can easily occur, and adhesion of foreign matters (ink, paper powder, products due to electro-discharging, dust, or the like) may take place.

The coefficient of static friction of the surface layer 6 can be obtained by using a measuring device for coefficient of static friction "HEIDON" manufactured by SHINTO KAGAKU under a condition of 25° C., placing a roll on which the underlayer 4 is formed at the outer peripheral surface of the metal core material 2 on the resin sheet constituting the surface layer 6, tilting the resin sheet gradually, and measuring tan (tangent) of the angle where the above-described roll shaft begins to slide.

The surface layer 6 includes a fluororesin. Because the charging roll of the present invention includes a fluororesin, the present invention can provide an charging roll which decreases the adhesion of ink and has a stable resistance range to environmental changes (a lower resistance range (volume resistivity is $10^6$ Ωcm) than that of the charging roll used in the ordinary method of the electrophotographic process (volume resistivity is $10^8$ Ωcm)). As a result, deterioration due to electro-discharging and direct current power voltage can be reduced and a high paper retention property on the belt, high image quality, high transfer property, and high reliability can be achieved. The above-described fluororesin is preferably at least one kind resin selected from a group consisting of a tetrafluoroethylene-perfluoroalkoxylalkylvinylether resin, an ethylenetetrafluoroethylene resin, and a poly(vinylidene fluoride) resin.

The surface layer 6 may contain conductive materials in addition to the fluororesin to adjust the resistance. Examples of the conductive materials include filler materials such as carbon black, which is an electron conductivity conductive material, as a conductive filler, carbon nano tube, graphite, Al, Ni, and copper; and composite oxides such as tin oxide, zinc oxide, potassium titanate, tin oxide-indium oxide, and stibium oxide, and examples of ion conductive materials include a surfactant based material such as ammonium salt, sulfonate, cationic, nonionic, anionic surfactants. These materials are preferably used so as to control the volume resistivity at 23° C. and 55% RH to $10^4$ to $10^8$ Ωcm.

The charging roll of the present invention having the configuration as described above has a surface resistivity of about $10^6$ Ω/square or less (more preferably $10^{5.5}$ Ω/square or less) at 23° C. and 55% RH, and the volume resistivity of about $10^4$ to $10^7$ Ωcm (more preferably about $10^{4.5}$ to $10^{6.5}$ Ωcm) at 23° C. and 55% RH, in light of stabilizing the resistance and reduction in the unevenness of charging under the condition of 10° C. and 110% RH.

Figure 2:
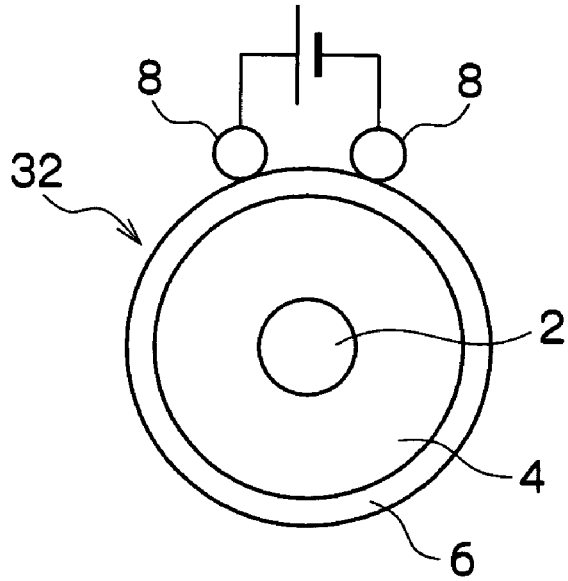
FIG. 2 is a drawing explaining a method of measuring the surface resistivity.

In order to obtain the surface resistivity at 23° C. and 55% RH, as shown in FIG. 2, two metal rolls 8 having 12 mm in diameter and 330 mm long made of SUS stainless steel are brought into contact with the surface of the above-described charging roll 32 with 0.2 mm thrust, the metal rolls being apart from each other at a distance of 10 mm in the circumferential direction of the surface of the charging roll, at a predetermined time after a voltage of 2 kV has been applied. A direct current voltage (V) of 1 kV is applied between the metal rolls 8, current (I) at 10 seconds after the application of voltage is read, and the surface resistivity $R_S$, is obtained from the equation below.

$$R_S = LV/GI$$

wherein, L denotes the length of the charging roll (cm) and G denotes the distance between the two metal rolls 8 (cm).

The volume resistivity is calculated by cutting out a piece of the roll of 1 cm in height, sandwiching the piece with metal plates, applying DC=100v, and performing a measurement of the resistance at 10 seconds after the application of the voltage.

The hardness of the charging roll in the present invention is preferably about 90 to 20° and more preferably about 60 to 30°. When hardness exceeds 90°, the belt nip becomes smaller and the stable charge may not be obtained in the direction of the belt surface. When the hardness is less than 20°, the area of the nip becomes larger and fluctuations in the belt speed may occur. The hardness referred hereto is the Asker C hardness and is a repulsion hardness at 500 g load.

Although the method of manufacturing the charging roll in the present invention is not specifically limited, the surface layer is preferably formed by covering a roll having an underlayer of a tube-shaped fluororesin composition formed at the outer peripheral surface of a metal core material. The charging roll of the present invention is preferably manufactured by the following method.

The charging roll of the present invention is produced in such a manner that the surface layer 6 is preferably formed by expanding the conductive tube formed of a resin composition including a tetrafluoroethylene-perfluoroalkoxylalkylvinylether resin, a polytetrafluoroethylene resin, a tetrafluoroethylene-hexafluoropropylene copolymer resin, an ethylene-tetrafluoroethylene resin, a poly(vinylidene fluoride) resin, or polyhexatetrafluoroethylene resin by pressure-feeding fluid in the inner peripheral surface of the expanded tube; inserting a conductive roll having an underlayer formed at the outer periphery of a metal core material into the inner peripheral surface of the expanded conductive tube; and contracting the conductive tube by stopping the pressure-feeding of the fluid (the first method).

The charging roll of the present invention is also produced in such a manner that the surface layer 6 is preferably formed by inserting the conductive roll having an underlayer formed at the outer periphery of the metal core material into the conductive tube formed of a resin composition of a fluororesin; cooling the conductive tube after it is cured by heating while vulcanizing; and adhering the conductive tube to the underlayer (the second method).

In the case that the underlayer 4 is a foamed layer, the charging roll of the present invention can be manufactured, for example, as follows. A foamed elastomer raw material is manufactured by adding a foaming agent, a vulcanizing agent and the like, to an unfoamed rubber raw material. In order to obtain a foamed elastomer having a hardness of 30° to 60°, it is important to control the amount of the foaming agent and foaming condition. After the foamed elastomer raw material is kneaded by a kneader, a Banbury mixer or the like, it is extruded form an extruder and is wound around the outer peripheral surface of the metal core material, which is sent to a crosshead. The metal core material wound with the foamed elastomer raw material is set in a mold and the elastic body material is heated and vulcanized. The rubber raw material foamed by heating is fixed to the metal core material and the foamed elastomer, which becomes the underlayer, is formed. Alternatively, a method of forming the foamed elastomer by molding the elastic body material into a tube-like form when the foamed elastomer raw material is extruded from an extruder and heating without winding the tube-like form on the metal core material may be used. Alternatively, the underlayer can be fixed to the outer peripheral surface of the metal core material by pressure-feeding the metal core material into the center of the foamed elastomer. After this, the surface of the underlayer is polished.

Separately, a conductive rubber material in which additives such as carbon black and vulcanizing agents are added to a fluororesin is manufactured. Thereafter, for example, a tube which becomes the surface layer is manufactured by extruding the conductive rubber materials into a tube-like form from an extruder having a crosshead which has a high productivity in a dry process.

In the first method, the surface layer 6 is formed in such a manner that a fluid is pressure fed to the inner peripheral surface of the obtained conductive tube, or a metal shaft having a larger inner diameter is inserted into the conductive tube, to expand the tube; and the conductive roll having an underlayer formed at the outer peripheral surface of the metal core material is inserted into the inner peripheral surface of the expanded conductive tube; and the conductive tube is contracted by stopping the pressure-feeding of the fluid.

In the second method, the outer peripheral surface of the underlayer is covered with the conductive tube by inserting the metal core material having the underlayer formed into the inner periphery of the obtained conductive tube and moving the metal core material having the underlayer at a fixed speed. Thereafter, by curing by vulcanizing or vulcanize-foaming the conductive tube by heating the conductive tube integrated with the metal core material in a vulcanizer under a pressurized vapor atmosphere, then cooling, the surface layer 6 is formed and at the same time adhered to the surface of the underlayer 4, or contracted or compressed onto the surface of the underlayer 4. The roll manufactured in this manner is taken out from the vulcanizer.

The method is finished by polishing the surface of the substrate roll manufactured in the above manner.

The inkjet recording apparatus of the present invention comprises an inkjet head unit having an inkjet head which ejects ink droplets onto a recording medium, a transporting belt which transports the recording medium to the inkjet head unit, and a charging roll to charge the surface of the transporting belt, wherein the charging roll is the roll for charging a belt for inkjet recording of the present invention, as describe above.

Hereinafter, preferred embodiments of the inkjet recording apparatus of the present invention will be described with reference to the drawings.

Figure 3:
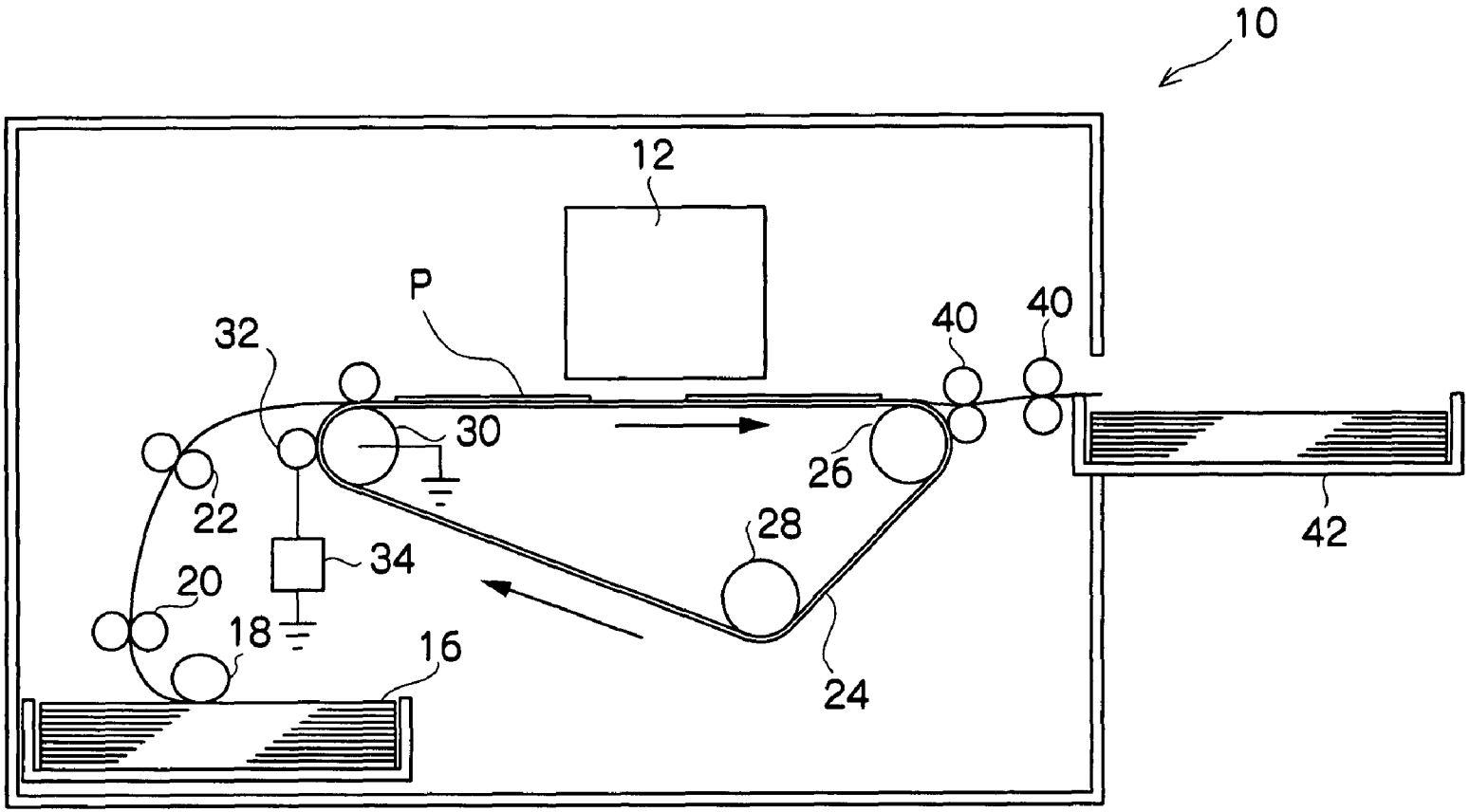
FIG. 3 is a schematic view showing a configuration of one example of inkjet recording apparatuses of the present invention.

As shown in FIG. 3, an inkjet recording apparatus 10 is equipped with an inkjet head unit 12 which ejects ink droplets onto a recording paper (recording medium) P, and the inkjet head unit 12 is equipped with an inkjet head (not shown) which ejects ink droplets of four colors, that is cyan (C), magenta (M), yellow (Y), and black (K), from nozzles corresponding to these colors, respectively. The inkjet head is an elongated head having an effective printing region which is the same or wider than the width of the recording paper P and can eject ink droplets simultaneously onto the printing region in the lateral direction of the recording paper P. As methods of ejecting ink droplets from the nozzles of the inkjet head, any known methods such as a method to pressurize an ink chamber with a piezoelectric element and a thermal method are applicable.

The inks are supplied to the inkjet head through pipes from ink tanks (not shown) located above the inkjet head unit 12, and various known inks such as water-based ink, oil-based ink, and solvent-based ink can be used.

A paper feeding tray 16 is removably disposed in the bottom part of the inkjet recording apparatus 10, the paper feeding tray 16 is loaded with the recording papers P, and a pick-up roll 18 abuts onto the uppermost recording paper P. The recording paper P is fed by the pick-up roll 18 one by one from the paper feeding tray 16 to the downstream in the transporting direction, fed to an endless transporting belt 24 by transporting rolls 20 and 22 arranged sequentially along a transporting path, and transported to the inkjet head unit 12 by the transporting belt 24.

The transporting belt 24 is trained over driving roll 26 and driven rolls 28 and 30. The driven roll 30 is grounded.

The transporting belt 24 is made of a rubber such as urethane and a resin such as PET, ETFE, polyimide, for example, and the volume resistance is $10^{10}$ Ωcm or higher.

The charging roll 32 to which a power source device 34 is connected, which is the charging roll of the present invention, is arranged at the upstream side of the position where the recording paper P is brought into contact with the transporting belt 24. The charging roll 32 is driven by the driven roll 30 such that the transporting belt 24 is sandwiched between the rolls 32 and 30, and the roll 32 is movable between a pressing position where the charging roll presses against the transporting belt 24 and a separating position where the charging roll is separated from the transporting belt 24. In the pressing position, the charging roll discharges to the transporting belt 24 and can impart electric charges, because an electric potential difference is generated between the charging roll and the grounded driven roll 30. Although the case in which the position where the charging roll is arranged at the upstream of the position where the recording paper P is brought into contact with the transporting belt 24 is explained, it is not limited to this, and the charging roll may be arranged at a position where the roll is not subject to the influence of dirt such as a paper dust and a ink mist in the apparatus.

The power source device 34 is formed of a waveform generator which generates a known and arbitrary voltage waveform and an amplifier.

A plurality of discharge roll pairs 40 which constitutes a discharge path for the recording paper P is installed at the downstream side of the inkjet head unit 12, and a discharge tray 42 is installed at the end of the discharge path formed of discharge roll pair 40.

Figure 4:
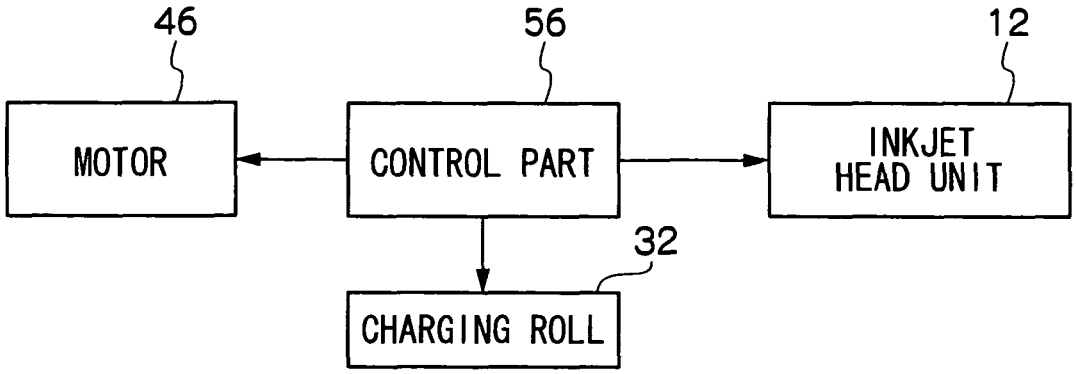
FIG. 4 is a block diagram showing a control system of an inkjet recording apparatus according to an embodiment of the present invention.

As shown in FIG. 4, each part of the inkjet recording apparatus 10 is controlled by a control part 56 composed of a CPU, ROM, and RAM, and the control part controls the entire inkjet recording apparatus 10 including the inkjet head unit 12, the charging roll 32, and a plurality of motors 46 which drive various rolls.

Next, the printing operation of the inkjet recording apparatus 10 will be explained. When the control part 56 receives a command for a printing job, the recording paper P is fed from the paper feeding tray 16 by driving the pick-up roll 18, all transporting rolls, and the transporting belt 24. A head control part (not shown) which performs a dummy jetting, initializes the performance of the nozzles in the inkjet head unit 12, and controls the ejection of ink droplets by the inkjet head unit 12 applies a driving voltage to the piezoelectric elements of the nozzles on a timely basis corresponding to image signals.

Accordingly, the recording paper P being transported by the transporting belt 24 is subjected to printing and the printing step will be described hereinafter in detail. The printed recording paper P is transported to the discharge tray 42 by the transporting belt 24 and the discharge roll pairs 40.

Figure 5:
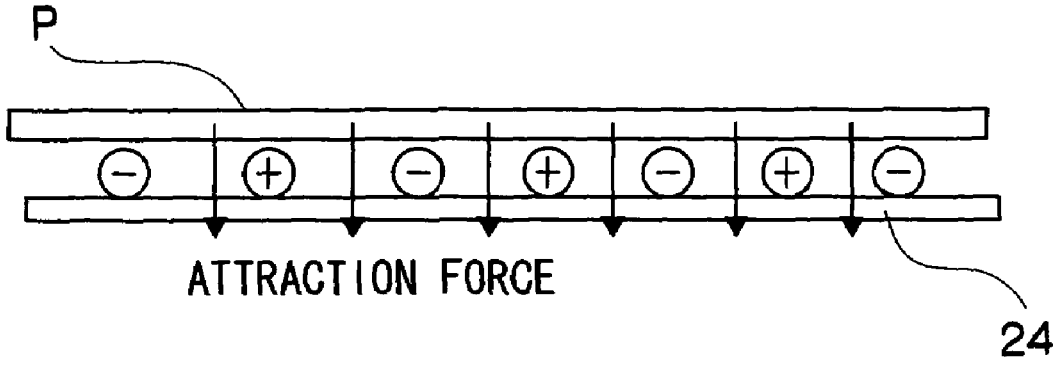
FIG. 5 is a pictorial diagram showing the electric charges charged on a transporting belt according to the present invention.

Here, the printing step is explained. When the control part 56 receives printing job signals, the charging roll 32 is turned on and a voltage which varies with the above-described superposed waveform from the power source device 34 is applied to the charging roll 32. When the charging roll 32 discharges the electric charges to the transporting belt 24, the residual charges are averaged in the charged areas on the surface of the transporting belt 24, by the voltage varying with a high-frequency voltage waveform of the superposed waveform, whereas only an charged pattern corresponding to a frequency of a low-frequency voltage waveform appears on the surface of the belt, and as shown in FIG. 5, the surface of the transporting belt 24 is charged with a positive charge and a negative charge alternatively. The recording paper P is stably attracted electrostatically onto the surface of the transporting belt 24 due to the stress (Maxwell's stress) by nonuniform electric field generated by the positive charges and negative charges. Since the surface of the transporting belt is charged with a positive charge and a negative charge alternatively, the effect of the electric field to the ejection of the ink droplets from the surface of the transporting belt 24 to the inkjet head unit 12 is small and because the recording paper P is not directly charged, the effect of an attraction force attributed to the characteristics of the recording paper (such as electric resistance and thickness) is small.

Accordingly, the recording paper P which is fed to the transporting belt 24 is electrostatically attracted to the transporting belt 24 and passes through the printing region of the inkjet head unit 12. At this time, the control part 56 actuates the inkjet head unit 12 and performs printing on the recording paper P. Then, the recording paper P is discharged to the discharge tray 42 by the discharge roll pairs 40. A part of the transporting belt 24 where the recording paper P is attracted rotationally moves again to the pressing part of the charging roll 32 by the driving roll 26 and the driven rolls 28 and 30, and at the same time that the residual charges on the transporting belt 24 are averaged by the voltage varying with the superposed waveform applied on the charging roll 32, the surface of the transporting belt is again charged with a positive charge and a negative charge alternatively corresponding to the frequency of the low-frequency voltage waveform, and a stable attraction force is maintained.

EXAMPLES

Hereinafter, the present invention is explained in detail with reference to examples, but the present invention is not limited to these examples.

Example 1

1 part by mass of sulfur (200 mesh, manufactured by Tsurumi Chemical Industrial Co., Ltd.) as a vulcanizing agent, 1.5 parts by mass of sulfur vulcanization accelerator (trade name: Nocceler M, manufactured by Ouchi Shinko Kagaku Kogyo Co. Ltd.), 6 parts by mass of benzenesulfonylhydrazide as a foaming agent, 6 parts by mass of Ketjen Black EC (manufactured by Lion Akzo Co., Ltd.), and 24 parts by mass of Asahi Thermal Black FT (manufactured by Asahi Carbon Co., Ltd.) are added to 100 parts by mass of non-foamed EPDM (trade name: EP33, manufactured by JSR), the mixture is kneaded by a kneader and Banbury mixer, and the rubber composition is extruded from an extruder in a tube-like form. Further, a foamed product in a tube-like form is obtained by performing foaming and vulcanization at 160° C. for 30 minutes.

A metal (SUS, stainless steel) shaft having 8 mm in diameter is inserted into the foamed product in the tube-like form, and fabricated by grinding to 18.7 mm in diameter, to obtain a foamed roll having an underlayer (foamed product).

A conductive PFA tube (conductive tube manufactured by Gunze Limited, 100 μm in thickness) is expanded by pressure feeding air into the inner peripheral surface thereof, the foamed roll is inserted into the inner peripheral surface of the expanded tube, and contracting the conductive PFA tube is contracted at 120° C. for 10 minutes by stopping the pressure feeding of the air so that a roll for charging a belt for inkjet recording having a surface layer (conductive PFA tube) is obtained.

The surface resistivity at 23° C. and 55% RH, the volume resistivity, and the hardness of the obtained charging roll are measured by the above-described method.

The nip resistance, the coefficient of static friction, and the thickness at 23° C. and 55% RH, at 10° C. and 10% RH, and at 28° C. and 85% RH, respectively, of the surface layer are measured.

The nip resistance and the thickness at 23° C. and at 55% RH, 10° C. and at 10% RH, and 28° C. and 85% RH, respectively, of the underlayer are measured. The results are shown in Table 1.

The obtained charging roll is used as the charging roll in the inkjet recording apparatus having a structure similar to that of the apparatus as shown in FIG. 3. A polyimide belt (volume resistivity at 23° C. and 55% RH: $10^{11.8}$ Ωcm, surface resistance: $10^{12.6}$ Ω/square) is used as a transporting belt 24 in the inkjet recording apparatus. Under the conditions of 23° C. and 55% RH, 10° C. and 10% RH, and 28° C. and 85% RH, respectively, a direct current voltage of 2 kV is applied to the charging roll, and using an ink (IC8CL33) manufactured by EPSON as an ink, an image is recorded by the inkjet recording apparatus. The ink stain, the property of paper attraction, and the charging characteristic on the charging roll 32 are evaluated. As a result, under each condition, an ink stain is not generated (the ink is transferred to the surface of the belt on SCOTCH clear tape manufactured by 3M, and the density of the ink is less than 0.15), the property of paper attraction is good (a paper on the belt does not peel off even after the ink printing), and the electrifying characteristic (DC 1.5 kV is applied onto the charging roll) is good (the electric potential on the surface of the belt is DC +950V).

Example 2

A roll for charging a belt for inkjet recording is manufactured in the same manner as Example 1 except that the added amount of Ketjen Black EC (manufactured by LION AKZO Co., Ltd.) used to manufacture the foamed product having a tube-like form in Example 1 is changed to 7 parts by mass and the added amount of Asahi Thermal Black FT (manufactured by Asahi Carbon Co., Ltd.) used to manufacture the foamed product having a tube-like form in Example 1 is changed to 28 parts by mass. The inkjet recording apparatus is used in the same manner as in Example 1 and the ink stain, the property of paper attraction, and the charging characteristic on the charging roll 32 are evaluated. As a result, under each condition, an ink stain is not generated (the ink is transferred to the surface of the belt on Scotch clear tape manufactured by 3M, and the density of the ink is 0.13), the property of paper attraction is good (a paper on the belt does not peel off even after the ink printing), and the charging characteristic is good (the electric potential on the surface of the belt is DC +930V).

Example 3

A roll for charging a belt for inkjet recording is manufactured in the same manner as in Example 1 except that 100 parts by mass of EPDM used to manufacture the foamed product having a tube-like form in Example 1 is changed to 100 parts by mass of an epichlorohydrin rubber (trade name: Epichlomer C, manufactured by Daiso Co. Ltd.), and 6 parts by mass of Ketjen Black EC (manufactured by LION AKZO Co., Ltd.) and 24 parts by mass of Asahi Thermal Black FT (manufactured by Asahi Carbon Co., Ltd.) are changed to 1 part by mass of triethylbenzylammonium salt. The inkjet recording apparatus is used in the same manner as in Example 1 and the ink stain, the property of paper attraction, and the electrifying characteristic on the charging roll 32 are evaluated. As a result, under each condition, an ink stain is not generated (the ink is transferred to the surface of the belt onto SCOTCH clear tape manufactured by 3M, and the density of the ink is 0.14), the property of paper attraction is good (a paper on the belt does not peel off even after the ink printing), and the charging characteristic is good (the electric potential on the surface of the belt is DC +980V).

Comparative Example 1

A roll for charging a belt for inkjet recording is manufactured in the same manner as in Example 1 except that the thickness of the conductive PFA tube (conductive tube manufactured by Gunze Limited) used in Example 1 is changed from 100 μm to 25 μm. The inkjet recording apparatus is used in the same manner as in Example 1 and the ink stain, the property of paper attraction, and the electrifying characteristic on the charging roll 32 are evaluated. As a result, under each condition, an ink stain is generated (the ink is transferred to the surface of the belt on Scotch clear tape manufactured by 3M, and the density of the ink is 0.25), the property of paper attraction is poor (a paper on the belt peels off even after the ink printing), and the charging characteristic is poor (the electric potential on the surface of the belt is DC +340V).

Comparative Example 2

A roll for charging a belt for inkjet recording is manufactured in the same manner as Example 1 except that the thickness of the conductive PFA tube (conductive tube manufactured by Gunze Limited) used in Example 1 is changed from 100 μm to 550 μm. The inkjet recording apparatus is used in the same manner as in Example 1 and the ink stain, the property of paper attraction, and the electrifying characteristic on the charging roll 32 are evaluated. As a result, under each condition, an ink stain is generated (the ink is transferred to the surface of the belt on SCOTCH clear tape manufactured by 3M, and the density of the ink is 0.16), the property of paper attraction is poor (a paper on the belt peels off even after the ink printing), and the charging characteristic is poor (the electric potential on the surface of the belt is DC +550V).

TABLE 1

| | | Example 1 | Example 2 | Example 3 | Comparative Example 1 | Comparative Example 2 |
|---|---|---|---|---|---|---|
| Underlayer | Nip Resistance (Ω, 10° C. and 10% RH) | $10^{7.5}$ | $10^{6.3}$ | $10^{8.8}$ | $10^{7.8}$ | $10^{6.4}$ |
| | Nip Resistance (Ω, 23° C. and 55% RH) | $10^{6.8}$ | $10^{5.8}$ | $10^{7.6}$ | $10^{6.8}$ | $10^{5.8}$ |
| | Nip Resistance (Ω, 28° C. and 85% RH) | $10^{6.3}$ | $10^{5.2}$ | $10^{6.4}$ | $10^{5.8}$ | $10^{5.4}$ |
| | Thickness (mm) | 5.33 | 5.34 | 5.35 | 5.36 | 5.35 |
| Surface Layer | Nip Resistance (Ω, 10° C. and 10% RH) | $10^{5.8}$ | $10^{5.7}$ | $10^{5.8}$ | $10^{9.5}$ | $10^{4.2}$ |
| | Nip Resistance (Ω, 23° C. and 55% RH) | $10^{5.6}$ | $10^{5.6}$ | $10^{5.3}$ | $10^{8.5}$ | $10^{3.6}$ |
| | Nip Resistance (Ω, 28° C. and 85% RH) | $10^{5.3}$ | $10^{5.4}$ | $10^{4.8}$ | $10^{7.0}$ | $10^{3.4}$ |
| | Coefficient of Static Friction | 0.25 | 0.22 | 0.27 | 0.42 | 0.35 |
| | Thickness (μm) | 100 | 98 | 102 | 25 | 550 |
| Charging roll | Surface Resistivity (Ω/square, 23° C. and 55% RH) | $10^{5.0}$ | $10^{4.8}$ | $10^{4.6}$ | $10^{8.5}$ | $10^{2.8}$ |
| | Volume Resistivity (Ω-Cm, 23° C. And 55% RH) | $10^{6.2}$ | $10^{5.6}$ | $10^{4.6}$ | $10^{8.2}$ | $10^{3.8}$ |
| | Hardness | 55 | 35 | 45 | 25 | 95 |

What is claimed is:

1. A roll for charging a belt for inkjet recording comprising a surface layer, including a fluororesin and having a nip resistance of about $10^4$ to $10^8$ Ω at 23° C. and 55% RH, formed on a conductive roll having an underlayer formed on the outer peripheral surface of a metal core material, wherein the nip resistance of the surface layer at 10° C. and 10% RH is lower than the nip resistance of the underlayer at 10° C. and 10% RH, and the nip resistance of the surface layer at 28° C. and 85% RH is higher than the nip resistance of the underlayer at 28° C. and 85% RH.

2. A roll for charging a belt for inkjet recording according to claim 1, wherein the coefficient of static friction of the surface layer is about 0.3 or less and the thickness of the surface layer is about 30 to 500 μm.

3. A roll for charging a belt for inkjet recording according to claim 1, wherein the surface resistivity at 23° C. and 55% RH is about $10^6$ Ω/square or less, and the volume resistivity at 23° C. and 55% RH is about $10^4$ to $10^7$ Ω cm.

4. A roll for charging a belt for inkjet recording according to claim 1, wherein the underlayer is a foamed layer.

5. A roll for charging a belt for inkjet recording according to claim 1, wherein the underlayer comprises at least one material selected from the group consisting of an ethylene-propylene-diene copolymer (EPDM), silicone rubber, urethane rubber, acrylonitrile-butadiene rubber (NBR), epichlorohydrin rubber (ECO), and polyether-urethane (PU) rubber.

6. A roll for charging a belt for inkjet recording according to claim 4, wherein the underlayer comprises at least one material selected from the group consisting of an ethylene-propylene-diene copolymer (EPDM), silicone rubber, urethane rubber, acrylonitrile-butadiene rubber (NBR), epichlorohydrin rubber (ECO), and polyether-urethane (PU) rubber.

7. A roll for charging a belt for inkjet recording according to claim 1, wherein, to form the roll for charging a belt for inkjet recording having the surface layer, a conductive tube formed of a resin composition containing a fluororesin is expanded by pressure feeding a fluid to an inner peripheral surface of the tube, the conductive roll having the underlayer formed on the outer peripheral surface of the metal core material is inserted into the inner peripheral surface side of the expanded conductive tube, and the conductive tube is contracted by stopping the pressure feeding of the fluid.

8. A roll for charging a belt for inkjet recording according to claim 1, wherein, to form the roll for charging a belt for inkjet recording having the surface layer, the conductive roll having the underlayer formed on the outer peripheral surface of the metal core material is inserted into a conductive tube formed of a resin composition containing a fluororesin, and the conductive roll and conductive tube are heated while vulcanizing to cure the conductive tube followed by cooling, so that the conductive tube is adhered to the underlayer.

9. A roll for charging a belt for inkjet recording according to claim 8, wherein the underlayer comprises at least one material selected from the group consisting of an ethylene-propylene-diene copolymer (EPDM), silicone rubber, urethane rubber, acrylonitrile-butadiene rubber (NBR), epichlorohydrin rubber (ECO), and polyether-urethane (PU) rubber.

10. A roll for charging a belt for inkjet recording according to claim 1, wherein the fluororesin is at least one kind selected from the group consisting of a tetrafluoroethylene-perfluoroalkoxylalkylvinylether resin, an ethylenetetrafluoroethylene resin, and a poly(vinylidene fluoride) resin.

11. An inkjet recording apparatus comprising an inkjet head unit having an inkjet head which ejects ink droplets onto a recording medium, a transporting belt which transports the recording medium to the inkjet head unit, and a charging roll to charge the surface of the transporting belt, the charging roll being the roll for charging a belt for inkjet recording according to claim 1.

* * * * *